US005895534A

United States Patent [19]

Daley et al.

[11] Patent Number: 5,895,534

[45] Date of Patent: *Apr. 20, 1999

[54] METHOD OF INCREASING THE YIELD STRENGTH OF COLD FORMED STEEL SECTIONS

[75] Inventors: Leigh Brian Daley, Bar Beach; Trevor Maxwell Height, New Lambton; Brian Roy Crossingham, Eleebana; Andrew Thomas Styan, Redhead, all of Australia

[73] Assignee: Tubemakers of Australia Limited, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 08/765,316

[22] PCT Filed: Jun. 27, 1995

[86] PCT No.: PCT/AU95/00378

§ 371 Date: Dec. 26, 1996

§ 102(e) Date: Dec. 26, 1996

[87] PCT Pub. No.: WO96/00305

PCT Pub. Date: Jan. 4, 1996

[30] Foreign Application Priority Data

Jun. 27, 1994 [AU] Australia ..... PM 6483

[51] Int. Cl.[6] ..... C21D 8/00

[52] U.S. Cl. ..... 148/624; 148/651

[58] Field of Search ..... 148/624, 651, 148/650, 652

[56] References Cited

U.S. PATENT DOCUMENTS 4,113,523 9/1978 Uchida et al. ..... 148/624

FOREIGN PATENT DOCUMENTS 53-12881 2/1978 Japan ..... 148/624

OTHER PUBLICATIONS

Patent Abstracts of Japan. C–201, p. 131, JP 60–43431 A, Mar. 8, 1985.

Derwent Abstract Accession No. 85–131062/22, JP 60–067627 A, Apr. 18, 1985.

Derwent Abstract Accession No. 92–328563/40, JP 04–236722 A, Aug. 25, 1992.

Patent Abstracts of Japan, C–298, p. 46, JP 60–67627 A, Apr. 18, 1985.

Patent Abstracts of Japan, C–253, p. 69, JP 59–133324 A, Jul. 31, 1984.

Patent Abstracts of Japan, C–844, p. 127, JP 03–82738 A, Apr. 8, 1991.

Patent Abstracts of Japan, M–348, p. 138, JP 59–153521 A, Sep. 1, 1984.

Derwent Abstract Accession No. 95–137266/18, JP 07–062486 A, Mar. 7, 1995.

*Primary Examiner*—Deborah Yee

*Attorney, Agent, or Firm*—Ostrolenk, Faber, Gerb & Soffen, LLP

[57] ABSTRACT

Yield strength of a cold rolled steel section is increased and controlled by performing a predetermined amount of strain by way of cold working in an in-line roll forming process followed by a controlled amount of strain aging wherein the temperature of the steel section is elevated to a point below 500° C. and held at an elevated temperature for a time up to 30 seconds. The heating typically takes place by induction heaters (16) and the time aging may be provided in an in-line galvanizing bath (17) before cooling the steel in a quench bath (18). The effect is further enhanced by further cold working and the consequent additional strain in forming rolls (19). For a given steel composition the degree of yield enhancement can be controlled by the temperature and tie parameters and also by the degree of initial roll forming in shaping rolls (10).

9 Claims, 2 Drawing Sheets

METHOD OF INCREASING THE YIELD STRENGTH OF COLD FORMED STEEL SECTIONS

TECHNICAL FIELD

This invention relates to a method of increasing the yield strength of cold formed steel sections during the course of in-line roll forming a steel strip to a desired structural shape.

BACKGROUND ART

The process of forming steel strip into desired structural shapes such as rectangular hollow section, circular tube, angles, channels and other open profile sections is well known and has been in use for many years. The feed material is normally so-called "black" steel which has typically been formed into steel strip by a hot rolling process in a manufacturing mill.

In the past one normally recognised method of obtaining increased yield strength of the finished product formed from a subsequent cold rolling process, is to alter the "chemistry" of the steel strip, i.e. by adding various alloying metals into the composition of the steel before hot rolling. Another method is the use of thermomechanical practice during hot rolling. These are expensive processes due to the cost of the metal alloy and the process for obtaining the desired mix of alloy, the technological cost of processing by thermomechanical practices, and also because of the necessity to keep inventory of different types of metal section in order to meet the demand for different performance characteristics at an economical price.

For these reasons, the vast majority of all cold rolled steel sections are formed from common black steel with the size and weight of the section simply being increased where desired to obtain the necessary load-bearing characteristics.

There are however many applications where it is desirable from both engineering and economic points of view to enhance the yield characteristics of the steel from which a structural section is formed in order to give increased performance compared with a similar section rolled from black steel in the conventional manner.

DISCLOSURE OF INVENTION

The present invention therefore provides a method of increasing the yield strength of cold rolled steel sections as part of an in-line manufacturing process, comprising the steps of passing a steel section which has been at least partially cold worked and thereby subjected to a predetermined amount of strain, through a heating stage wherein the temperature of the steel section is elevated to a range between 200° C. and 500° C., and holding the temperature of the steel section in that temperature range for a time range between two and thirty seconds, the temperature and time combination being selected within the said ranges to achieve a predetermined degree of strain ageing.

Preferably the method includes steps of cooling the steel section after heating and strain ageing and then performing subsequent cold working on the steel section.

Preferably the step of passing the steel section through a heating stage comprises heating the steel section to a temperature between 200 and 450° C. over a time between two and thirty seconds and holding the temperature at at least 440° C. for between one and fifteen seconds.

More preferably the step or passing the steel section through a heating stage comprises heating the steel section to a temperature between 350 and 400° C. over a time between two and ten seconds and holding the temperature between 440 and 460° C. for between two and six seconds.

The step of cooling the steel section reduces the temperature of the section to below 90° C. and preferably to between 25 and 45° C. before subsequent cold working.

In one form of the invention the steps of elevating the temperature and holding that elevated temperature are performed by the preheating and subsequent coating of the steel section in an in-line galvanising operation.

Preferably the steel section has a steel composition containing between 0.01 and 0.25% carbon and between 0.001 and 0.006% nitrogen.

BRIEF DESCRIPTION OF DRAWINGS

Notwithstanding any other forms that may fall within its scope, one preferred form of the invention will now be described by way of example only with reference to the accompanying drawings in which.

MODES FOR CARRYING OUT THE INVENTION

Figure 1:
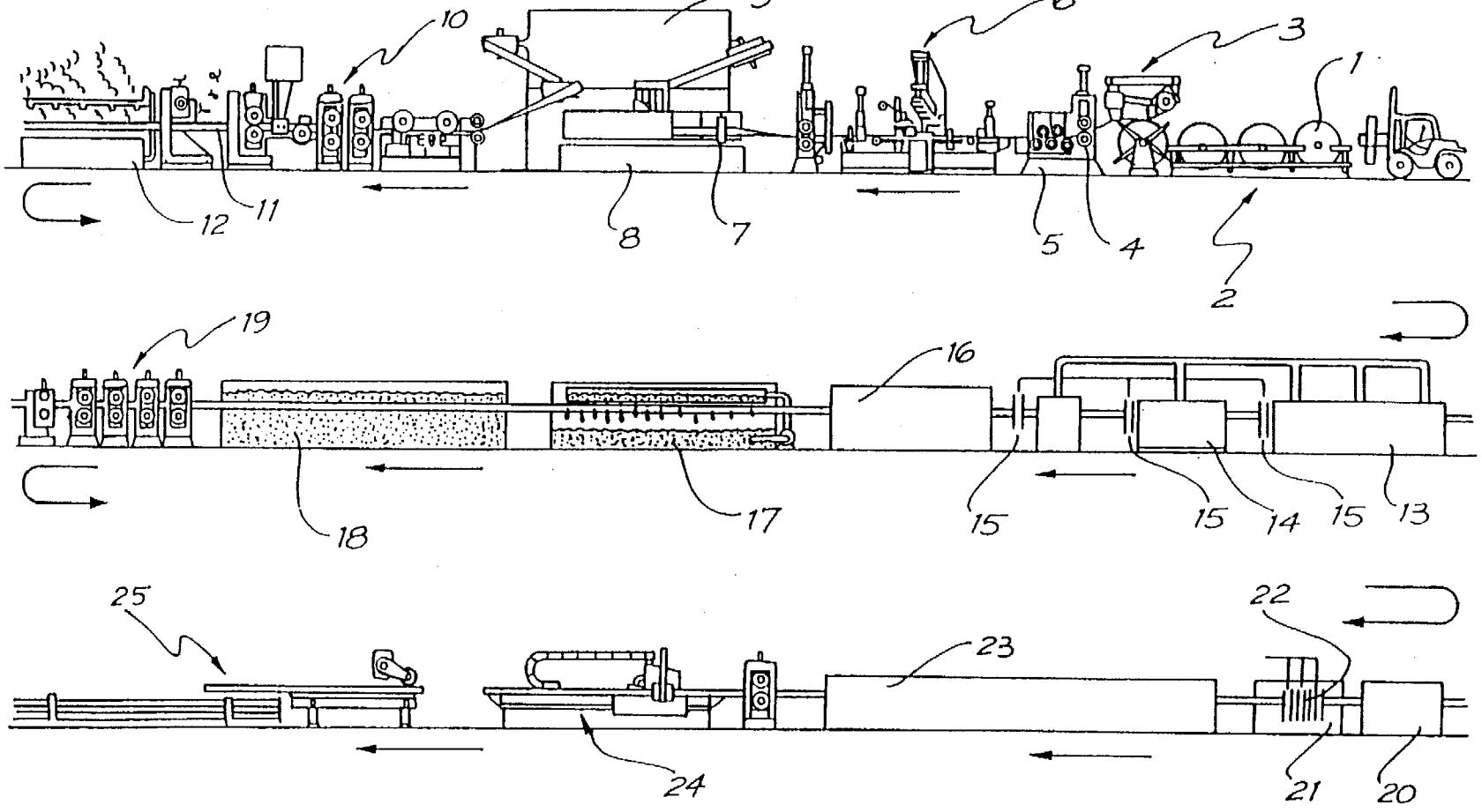
FIG. 1 is a line diagram of a mill for the continuous forming by cold working of heavy gauge hollow sections from steel strip.

In one form of the invention as will now be described the heating of the steel strip after initial cold working is performed as part of an in-line galvanising process although it will be appreciated that the heating could be performed independently of galvanising on a plain black steel section.

The cold working mill shown in the attached drawing takes coils of hot rolled steel strip 1 which are placed in a coil feed magazine 2 before the strip is unrolled and passed through an uncoiling station 3, pinch rolls 4 and leveller rollers 5 to flatten the strip and remove any coil set. The strip then passes through a splice welding station 6 where subsequent coils are joined end-to-end to form a continuous feed strip for the mill.

The strip is then pulled by pinch rolls 7 into an accumulation system 8 and then fed through a shot blast station 9 to prepare the surface of the steel strip.

The initial roll forming of the strip is performed in the shape preparation machine 10 where the initial cold working takes place as the steel section is deformed to its initial configuration at approximately atmospheric temperature and, where it is desired to form a hollow section, longitudinal edge welding of the strip takes place.

The steel section 11 then passes into a cooling section 12 to cool the metal after the welding operation.

Where it is desired to provide an in-line coating, e.g. a galvanised coating of the section, the section then passes through an acid pickling stage 13 and a rinsing stage 14 with wiping of the surface being effected after each stage by air knives 15 to remove excess liquid.

The section then passes into heating apparatus 16 which may be by any suitable form but is preferably conducted by electric induction heating. This may be carried out in an inert gas atmosphere in order to preserve the surface condition of the steel section. The induction heating phase raises the temperature of the section to between 200 and 450° C. over a time period between two and thirty seconds. In the preferred form of the invention the induction heating raises the temperature to between 350 and 400° C. over an exposure time of between two and six seconds.

The heated section then passes rapidly into an in-line galvanising stage 17 where, as part of the galvanising process, the temperature of the section is held between 440° C. and 460° C. for between one and fifteen seconds. In the most preferred form of the invention the temperature in the galvanising stage is held between 445° C. and 455° C. for between two and six seconds.

The section then passes through a quenching station 18 where the temperature of the section is reduced to between 25 and 45° C.

Figure 2:
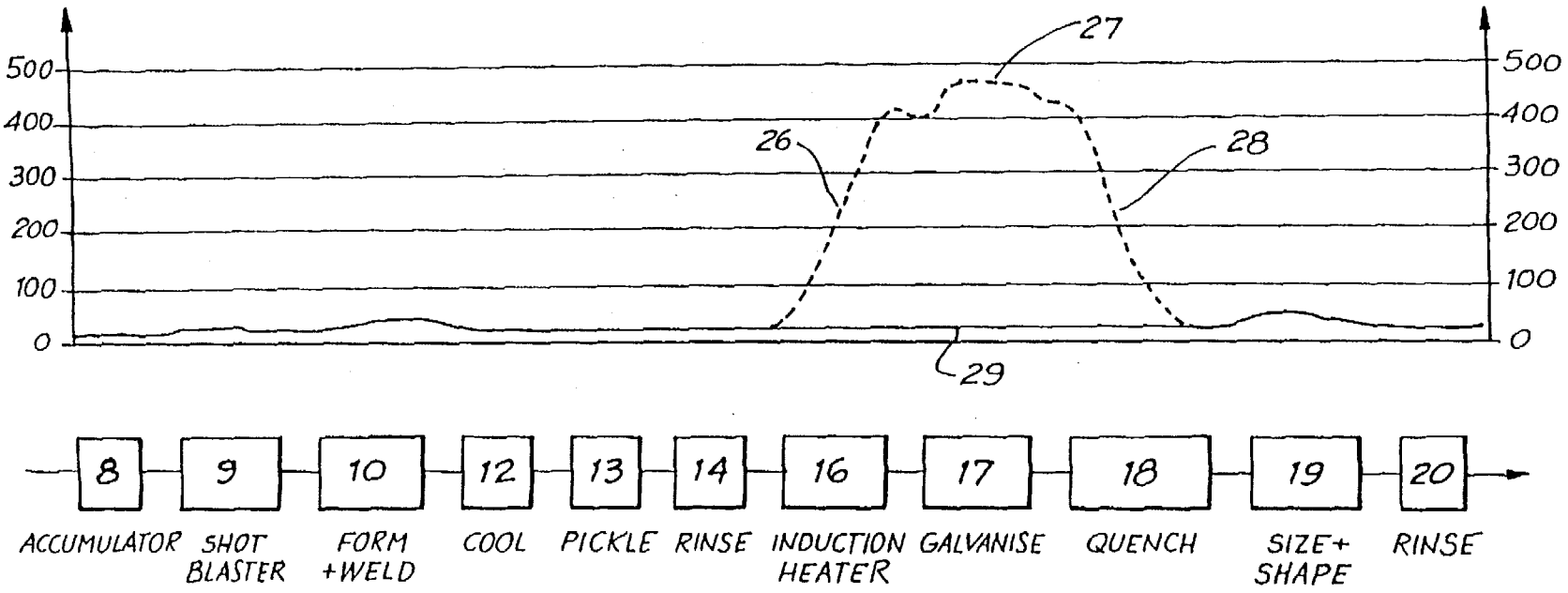
FIG. 2 is a graph of the temperature of a steel section passing through the mill shown in FIG. 1.

These temperature profiles can be clearly seen in FIG. 2 where the numbers in the boxes at the foot of the graph relate to the different stages in the roll forming process shown in FIG. 1 and are designated by similar numbers and wherein the temperature rise in the induction heater 16 is shown at 26 and the temperature holding profile in the galvanising bath at 27. The quenching taking place at 18 results in the temperature profile 28. By way of comparison, the normal cold roll forming process for black steel which is not galvanised can be seen at 29.

Subsequent final forming by cold working is then performed by the forming rolls 19 before the section passes through a rinsing station 20 and a coating station 21 where the section may be dried by air knives 22 and a final coating, e.g. of clear polymer may be applied.

Finally the section passes through a drying station 23 to a flying saw 24 where it is cut into desired lengths and passed to an unloading station 25.

By elevating the temperature of the section between the initial cold working in the shape preparation machine 10 and the final forming rolls 19, a "strain aging" operation is performed on the steel section which considerably enhances the yield strength and the ultimate tensile strength of the product compared with cold formed steel sections which are not heated between the initial and final cold rolling operation. For continuously cast Al-Si killed 1015 type steels, this increase in strength is typically 55 MPa for the yield strength and 50 MPa for the ultimate tensile strength. For continuously cast Al—Si killed 1006 type steels, this increase in strength is typically 30 MPa for the yield strength and 30 MPa for the ultimate tensile strength. The degree of strength enhancement depends on the amount of cold working occurring in the initial and final forming operation, the temperature and duration of the heating in-stages 16 and 17 and the chemical composition of the steel, particularly the carbon content.

The degree of strength enhancement can therefore be tailored to any desired end product either by controlling the parameters of the heating and strain ageing process as set forth above or more particularly by controlling the amount of cold working occurring in the initial operation, i.e. typically in the shape-forming rolls 10. A certain amount of inherent strain will occur in preforming the base steel strip to the desired shape before galvanising but if this is insufficient to achieve the desired amount of yield or strength enhancement, an "artificial" degree of strain may be added at this point. This may be achieved either by longitudinal working of the metal strip, e.g. to a curved profile and then back to a flat profile or by lateral working by passing the flat steel strip in an "S" profile or similar, i.e. through a sinusoidal path or between pairs of bridal rolls. As the strain ageing process builds upon the strain induced by the initial cold working it is therefore possible to tailor the ultimate yield characteristics of the finished product by controlling the amount of initial strain in this manner.

The chemical composition of the steel and in particular the carbon composition have also been found to have a significant effect on the degree of yield enhancement relating from the initial strain and subsequent strain ageing. The effect has been found to be applicable over carbon ranges between 0.01% and 0.25% carbon in the steel and nitrogen ranges between 0.0015% and 0.0045%. Particularly advantageous results have been achieved with carbon contents in the 0.04% to 0.17% ranges. The effect has been found to be equally applicable to hot rolled strip and standard general purpose cold rolled strip base materials with carbon and nitrogen contents in these ranges.

Although the preferred form of the invention has been described as one incorporating an in-line galvanising station 17, the increased yield strength effect is independent of whether the section is galvanised or not as it is the heating in stages 16 and 17 which contributes to the strain aging of the steel section. It is of course possible to omit the galvanising station 17 and simply to heat the black steel section in the heating stage 16 and hold it over the defined temperature range for the defined time in order to obtain the increased strength properties of the steel section.

We claim:

1. A method of increasing the yield strength of cold rolled steel sections as part of an in-line manufacturing process, comprising the steps of passing a steel section which has been at least partially cold worked and thereby subjected to strain, through a heating stage wherein the temperature of the steel section is elevated to a range between 200° C. and 500° C., and holding the temperature of the steel section in that temperature range for a time range between two and thirty seconds, the temperature and time combination being selected within the said ranges to achieve a predetermined degree of strain ageing.

2. A method as claimed in claim 1 including the steps of cooling the steel section after heating and strain ageing and then performing subsequent cold working on the steel section.

3. A method as claimed in claim 1 wherein the temperature of the steel section is elevated to a range between 200 and 450° C. over a time between two and thirty seconds and wherein the temperature of the steel section is then held at at least 440° C. in a time range between one and fifteen seconds.

4. A method as claimed in claim 1 wherein the temperature of the steel section is elevated to a range between 350 and 400° C. over a time between two and ten seconds and wherein the temperature of the steel section is then held at between 440° C. and 460° C. in a time range between two and six seconds.

5. A method as claimed in claim 2 wherein the step of cooling the steel section reduces the temperature of the section to below 90° C. before subsequent cold working.

6. A method as claimed in claim 5 wherein the step of cooling the steel section reduces the temperature of the section to between 25° C. and 45° C. before subsequent cold working.

7. A method as claimed in claim 1 wherein the steps of elevating the temperature and holding that elevated temperature are performed during the preheating and subsequent coating of the steel section in an in-line galvanising operation.

8. A method as claimed in claim 1 wherein the steel section has a steel composition containing between 0.01 and 0.25% carbon.

9. A method as claimed in claim 1 wherein the steel section has a steel composition containing between 0.001 and 0.006% nitrogen.

* * * * *